US005839747A

United States Patent [19]

Gervasoni

[11] Patent Number: 5,839,747

[45] **Date of Patent: *Nov. 24, 1998**

[54] BINDING ANCHOR

[75] Inventor: Bernard Gervasoni, Corona, Calif.

[73] Assignee: Thermal Snowboards, Inc., Corona, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 589,717

[22] Filed: Jan. 22, 1996

[51] Int. Cl.[6] ..... A63C 9/00; A63C 11/26

[52] U.S. Cl. ..... 280/611; 280/14.2; 280/607

[58] Field of Search ..... 280/14.2, 601, 280/607, 610, 611; 411/82, 84, 107, 108

[56] References Cited

U.S. PATENT DOCUMENTS

| | | | |
|---|---|---|---|
| 2,385,777 | 10/1945 | Ebert | 411/84 |
| 3,019,865 | 2/1962 | Rohe | 411/82 |
| 3,504,723 | 4/1970 | Cushman et al. | 411/82 |
| 3,915,466 | 10/1975 | Matsuda | 280/617 |
| 3,917,299 | 11/1975 | Anderson | 380/607 |
| 4,667,977 | 5/1987 | Lacroix | 280/602 |
| 4,706,985 | 11/1987 | Meatto | 280/610 |
| 4,711,462 | 12/1987 | Hayashi et al. | 280/610 |
| 4,725,070 | 2/1988 | Maruyama | 280/610 |
| 4,731,038 | 3/1988 | Hancock et al. | 441/68 |
| 4,781,395 | 11/1988 | Fischer | 280/610 |
| 4,871,337 | 10/1989 | Harris | 441/74 |
| 4,995,631 | 2/1991 | Hunter | 280/607 |
| 5,096,217 | 3/1992 | Hunter | 280/607 |
| 5,197,752 | 3/1993 | Engelbert et al. | 280/610 |
| 5,221,105 | 6/1993 | Mayr et al. | 280/633 |
| 5,303,948 | 4/1994 | Le Masson et al. | 280/607 |
| 5,320,378 | 6/1994 | Wiig | 280/610 |
| 5,401,041 | 3/1995 | Jespersen | 280/14.2 |
| 5,609,351 | 3/1997 | Vermillion | 280/611 |
| 5,632,583 | 5/1997 | Schneider et al. | 411/84 |
| 5,673,927 | 10/1997 | Vermillion | 280/14.2 |

FOREIGN PATENT DOCUMENTS

| | | | |
|---|---|---|---|
| 2431868 | 3/1980 | France | 280/611 |

OTHER PUBLICATIONS

PTO 98–434, Translation of French Patent 2,431,868 to "Look S.A." published Feb. 22, 1980; [translation 11/1997].

*Primary Examiner*—J. J. Swann
*Assistant Examiner*—Frank Vanaman
*Attorney, Agent, or Firm*—Fulwider Patton Lee & Utecht, LLP

[57] ABSTRACT

A system for anchoring a binding to a ski by incorporating a backing plate within the laminated structure of the ski. The backing plate has holes formed therein to receive internally threaded inserts therethrough and each of such holes is countersunk in a configuration to rotationally lock the insert in position. The binding is attached by engaging the appropriate inserts with threaded fasteners.

15 Claims, 2 Drawing Sheets

BINDING ANCHOR

BACKGROUND OF THE INVENTION

The present invention generally relates to the attachment of bindings to a ski device and more particularly pertains to the anchoring of fasteners to the interior structure of the ski device in order to enhance the strength of such mounting.

Modern skis, including waterskis, alpine and cross-country snow skis as well as snowboards, can have fairly complex internal structures wherein a plurality of different materials are combined in order to achieve desired strength, flexibility and damping characteristics. The net effect of such characteristics defines the performance envelope as well as the feel of a ski. A wood core is often employed which is encased in layers of plastic resins to define a bottom surface for contacting the snow or water and a top surface for supporting the skier. Bindings of various configurations are available for mounting to the ski and serve to transfer loads between the ski and the skier. The forces the various components are subjected to can be of significant magnitude.

The mounting of bindings to the skis is typically accomplished by the use of threaded fasteners that are driven directly into the interior structure. Such a configuration is, however, prone to pull out unless a relatively hard and expensive wood core is used. In addition to increasing the cost of the ski, use of such a core may not impart the desired performance characteristics to the ski. The use of large diameter fasteners may alternatively be relied upon to increase the tensile strength of the binding to ski interconnection but may similarly interfere in the performance of the ski.

Alternatively, rails or grooves have been incorporated in a ski's structure to serve as an anchoring device to which the bindings are affixed. While such a configuration may overcome any pull out problems, such a component is relatively expensive and the incorporation of such substantial hardware within the structure of the ski could again adversely affect the performance of the ski.

As a further alternative, it has been proposed to through-bolt the binding to ski, albeit typically as a means to repair a pulled-out mounting. This, however, has the disadvantage of disrupting the continuity of the bottom surface of the ski as the presence of the bolt head surfaces, even when mounted as flush as possible, would affect the sliding characteristic of the ski across the snow.

An improved system for mounting a binding to a ski, and more particularly for anchoring a fastener in the ski is needed that is not prone to pull out, does not adversely affect the performance characteristics of the ski and achieves such goal in an economical manner.

SUMMARY OF THE INVENTION

The present invention provides for the attachment of a binding to a ski by employing an anchoring system that is fully integrated within the internal structure of the ski without adversely affecting the performance characteristics of the ski. As such, the anchoring system serves to overcome the shortcomings of the prior art.

In accordance with the invention, a flexible backing plate is incorporated within the laminated structure of the ski. The plate is preferably positioned against the bottom side of the ski's central core. The plate has plurality of perforations formed therein that are dimensioned to receive internally threaded inserts that extend through the plate and core to near the top surface of the ski. Each insert-receiving perforation in the backing plate is countersunk to accommodate the head of the insert and shaped so as to cooperate with the shape of the insert's head to rotationally lock it in place.

Additional perforations across the face of the backing plate and along its edges serve to permit the influx of resin through and around the plate during the lamination process. As the resin hardens, the plate becomes fully integrated within the ski's internal structure and is thereby securely locked in place. The plate has substantially rounded corners so as to avoid the formation of undesirable stress risers that could otherwise lead to the failure of the laminate when the ski is subjected to substantial loads. The backing plate's flexibility renders its presence substantially transparent with a negligible effect on the ski's performance characteristics.

The backing plate may be formed in any of a variety of shapes in order to accommodate a pattern of inserts that are needed to mount bindings throughout the anticipated range of attachment positions. Preferred shapes include an oblong shape, a composite of joined circular discs or a series of circular disc pairs. The plate may optionally be countersunk into the bottom surface of the wood core.

These and other features and advantages of the present invention will become apparent from the following detailed description of the preferred embodiments which, taken in conjunction with the accompanying drawings, illustrate by way of example the principles of the invention.

DETAILED DESCRIPTION OF THE PREFERRED EMBODIMENTS

The figures illustrate embodiments of the anchoring system of the present invention which facilitate the secure attachment of bindings to a ski device such as, for example, a snowboard. The various components are integrated in the ski during the lamination process to provide a plurality of internally threaded inserts terminating along the top surface of the ski. Bindings are fastened directly to the ski by engaging the appropriate pattern of the threaded bores with screws or bolts.

Figure 1:
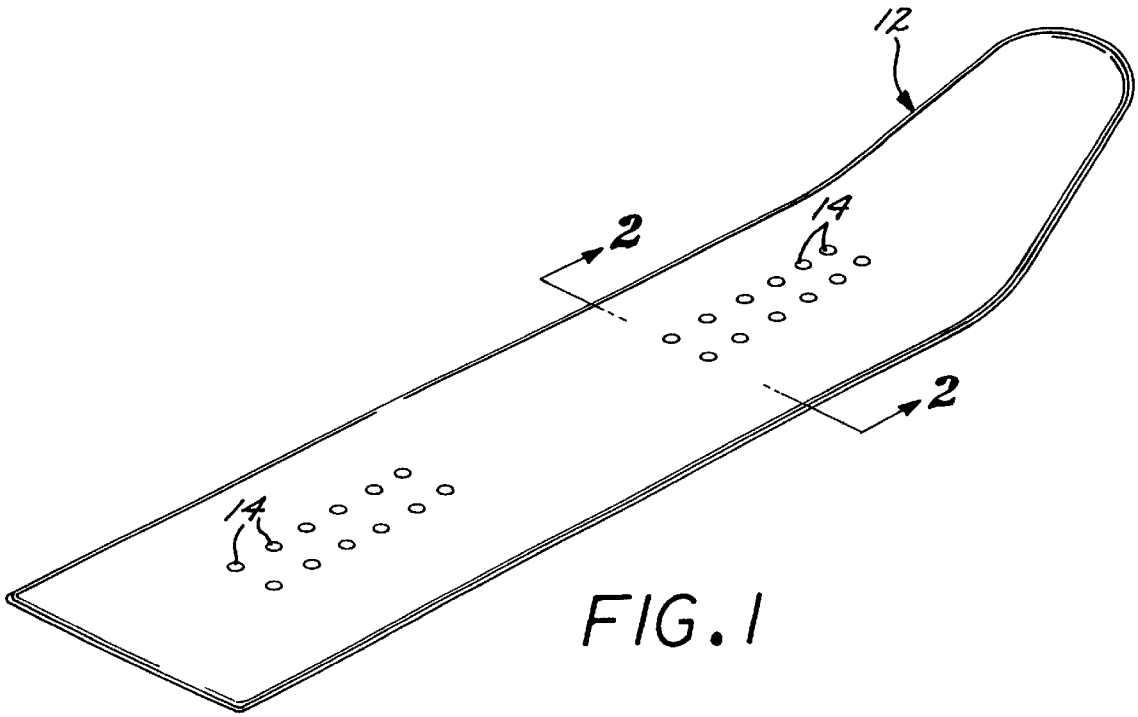
FIG. 1 is a perspective view of a snowboard showing the position of a preferred embodiment of the anchoring system of the present invention.
Figure 2:
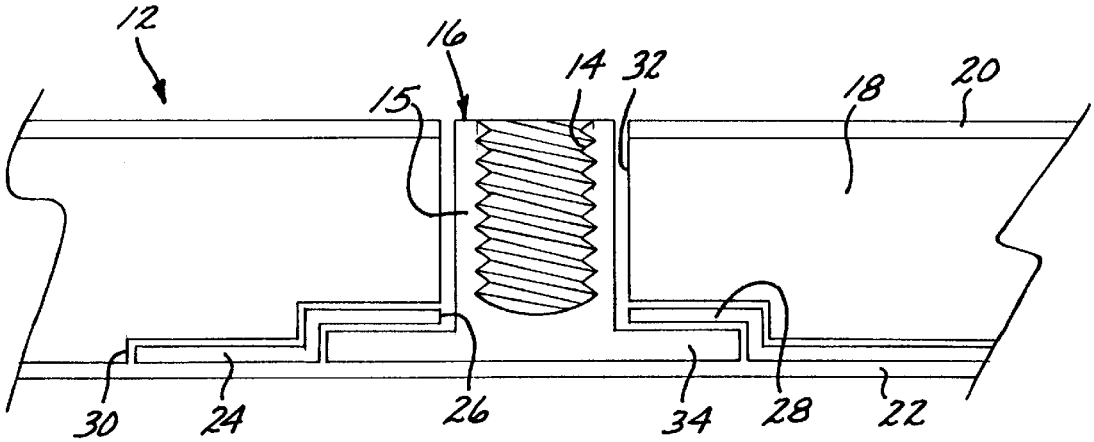
FIG. 2 is a greatly enlarged cross-sectional view taken along lines 2—2 of FIG. 1.

FIG. 1 illustrates the general positioning of the anchoring system of the present invention as adapted to a snowboard 12. The two arrays of threaded bores 14 terminating on the board's top surface enable bindings of different sizes to be positioned thereon throughout a range of relative spacings. FIG. 2 is a greatly enlarged cross sectional view showing a single one of the inserts 16, in which the threaded bore 14 is formed, and the manner in which the insert is anchored in the ski. The structure of the ski shown comprises a core 18 sandwiched between a top surface 20 and a bottom surface 22. A backing plate 24 is positioned against the bottom surface of the core. The backing plate has a hole 26 formed therein that is centrally located in a countersink 28. The bottom face of the core 18 has a recess 30 formed therein to accommodate the backing plate 24 including the countersink 28, while a bore 32 extending through the core is aligned with the hole formed in the backing plate. The insert 16 has a shank 15 which is internally threaded 14 and a head 34 which may have any of various geometric configurations. In the preferred embodiments illustrated, the head shape is hexagonal. The countersink 28 has the corresponding geometry so as to rotationally lock the insert 16 in position upon insertion.

Figure 3:
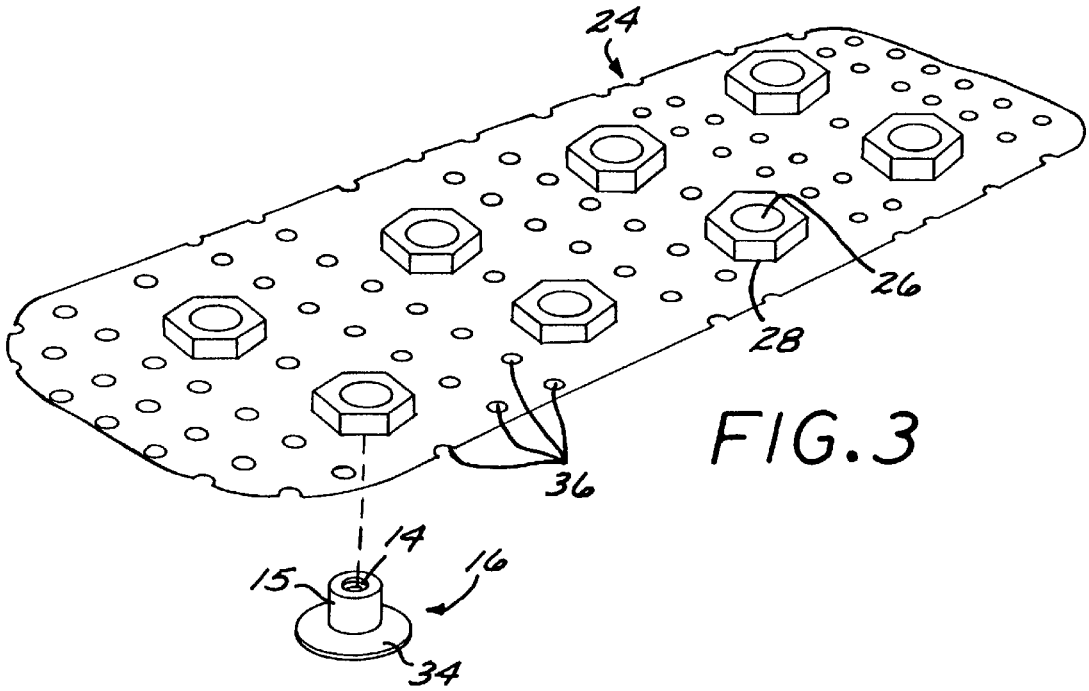
FIG. 3 is a perspective view of a preferred embodiment of the present invention.

As is shown in FIG. 3 the backing plate 24 has a plurality of countersunk holes 26 formed therein as well a multitude perforations 36 distributed across its face as well as along its edges. The plate is stamped/formed of 0.015" 304 stainless steel. The insert 16 comprises machined or cast stainless steel.

Figure 4:
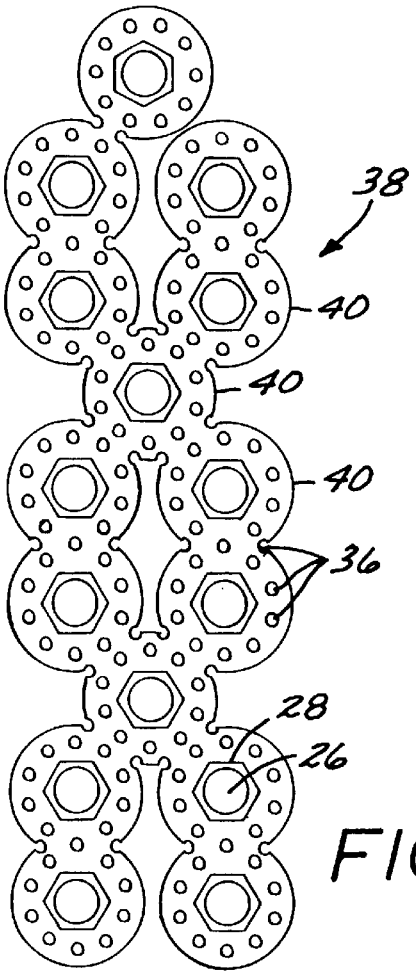
FIG. 4 is a top plan view of another preferred embodiment of the present invention.

FIG. 4 shows another preferred embodiment of the invention wherein the backing plate 38 takes the form of a conglomeration of joined circular discs 40 each surrounding a hexagonal countersink 28 and a concentric hole 26. The smaller perforations 36 are arranged so as to an encircle each countersink.

Figure 5:
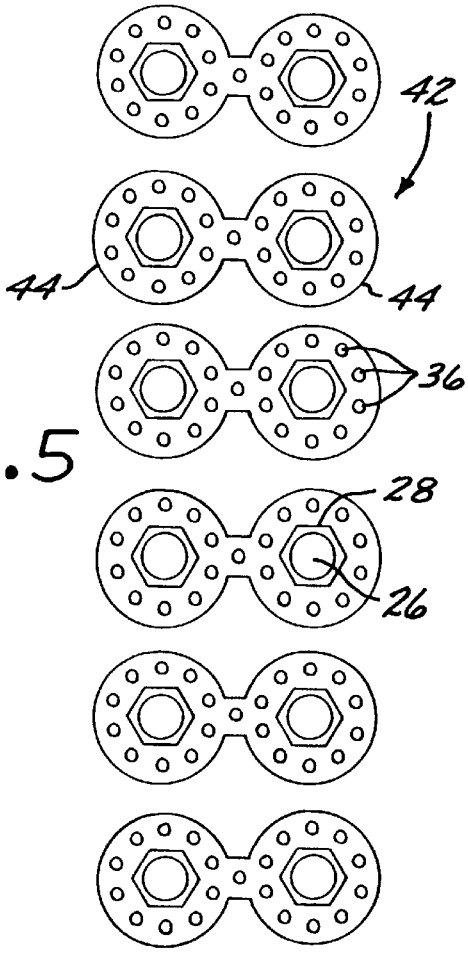
FIG. 5 is a top plan view of a further preferred embodiment of the present invention.

FIG. 5 illustrates the most preferred embodiment wherein a series of backing plates 42 is employed, each consisting of a pair of joined circular discs 44. Each disc has a hexagonal countersink 28 surrounding a hole 26 formed at its center. The smaller perforations 36 are arranged so as to encircle each of the countersunk holes 26.

In assembling the ski, the core consisting of either solid wood or of laminated strips or sheets is provided which is bored and routed to form holes 32 and countersinks 30 in the appropriate pattern. The backing plates 24, 38, or 42 are placed in position after which the inserts 16 are extended through the backing plates and pressed into the core 18. By slightly undersizing the bores 32 formed in the core, an interference fit is achieved between the insert and the core which serves to hold the assembly together during subsequent processing. The insert bores 14 are temporarily masked to prevent the intrusion of the resin that is used in the lamination process. During injection or hand application of the resin and subsequent pressure molding, the small perforations 36 in the backing plates ensure that the resin gains complete access in and around the backing plate. Upon hardening, the resin extending through the holes in its face and along its edges serves to mechanically lock the plate in place and thereby filly integrates the metal backing plate within the lamination.

In mounting a binding to the finished ski, screws or bolts are simply extended through flanges in the bindings and threaded into those bores that define the appropriate pattern for a particular binding configuration and positioning. The cooperation of the hexagonal insert head 34 with the hexagonal countersink 28 in the backing plates 24, 38, or 42 prevents rotation while the fastener is being tightened. In use, the backing plate serves to distribute loads exerted on the insert 16 to a substantial area of core to thereby effectively obviate the possibility of pull-out even when using very light weight or inexpensive cores. The rounded corners prevent the formation of stress risers to thereby maintain the integrity of the laminate and enhance the ski's load bearing capacity as well as extend its service life.

While a particular form of the invention has been illustrated and described, it will also be apparent to those skilled in the art that various modifications can be made without departing from the spirit and scope of the invention. Most notably, the anchoring system of the present invention can be incorporated in any ski design to enhance the strength of the binding mounting, any of a wide variety of interlocking insert head and countersink geometries can be employed and the backing plate can assume any shape and size that adequately distributes the anticipated loads. Accordingly, it is not intended that the invention be limited except by the appended claims.

What is claimed is:

1. A ski device having an anchoring system incorporated therein for mounting a binding thereto, comprising:

a ski having a core disposed therein;

a flexible, stamped backing plate, disposed within the ski below said core, said plate having countersunk holes formed therein, each said countersink having a non-circular shape; and a plurality of rigid inserts, each having an internally threaded shank extending through one of said holes in said plate and each insert having a head of a cross-section greater than said shank and configured to cooperate with the countersink so as to preclude rotation of said insert.

2. The ski device of claim 1 wherein said insert head and said countersink have a hexagonal shape.

3. The ski device of claim 1 wherein said backing plate has holes formed therein so as to facilitate the flow of resin therethrough during the construction of said ski.

4. The ski device of claim 1 wherein said backing plate is formed of flexible material.

5. The ski device of claim 4 wherein said flexible material comprises stainless steel.

6. The ski device of claim 1 wherein said backing plate has rounded corners.

7. The ski device of claim 1 wherein said backing plate has an oblong shape with a plurality of said countersunk holes formed therein.

8. The ski device of claim 1 wherein said backing plate comprises a plurality of joined circular discs, each disc having one of said countersunk holes centered therein.

9. The ski device of claim 1 wherein said backing plate comprises joined disc pairs, each having formed at its center one of said countersunk holes.

10. A snowboard having an anchoring system incorporated therein for mounting a binding thereto, comprising;

a snowboard having a core disposed therein;

a stamped, flexible backing plate disposed within the snowboard below said core, said plate defining two circular discs that are joined, each of said discs having a countersunk hole centered therein, wherein said counter sink has a hexagonal shape; and two rigid inserts, each having an internally threaded shank extending through the hole in one of said circular discs and having a hexagonal head dimensioned for receipt in said countersink.

11. The snowboard of claim 10 wherein said discs have a plurality of perforation formed therein surrounding said countersink.

12. A method for anchoring a binding to a ski of laminated construction including a core member, comprising the steps of:

selecting a plurality of rigid inserts, each having an internally threaded shank and a head of a cross section greater than that of said shank;

selecting a flexible, stamped, backing plate having countersunk holes formed therein, each said hole being dimensioned to receive said shank of one of said inserts and each of said countersinks being configured to cooperate with said head of one of said inserts to preclude rotation thereof therein;

perforating said core member to receive said inserts;

placing said backing plate against the bottom surface of said core;

inserting said inserts through said backing plate and said core;

constructing said ski by encasing said core in a resin; and attaching a binding to said ski by threadably engaging said inserts.

13. The method of claim 12 further comprising the step of dimensioning said perforation formed through said core to be slightly undersized relative to said shank so as to create an interference fit upon insertion.

14. The method of claim 12 further comprising the step of countersinking the bottom surface of said core to receive said backing plate.

15. The method of claim 12 wherein said insert head has a hexagonal shape.

* * * * *